US006009668A

United States Patent [19]

Reddy

[11] Patent Number: 6,009,668

[45] Date of Patent: Jan. 4, 2000

[54] POWER DOOR OPERATOR HAVING ROTARY DRIVE AND DRIVE OPERATED DIRECT PANEL LOCK

[75] Inventor: Redreddy Sukumar Reddy, Evanston, Ill.

[73] Assignee: Westinghouse Air Brake Company, Wilmerding, Pa.

[21] Appl. No.: 08/744,342

[22] Filed: Nov. 7, 1996

Related U.S. Application Data

[63] Continuation of application No. 08/744,342, Nov. 7, 1996

[60] Provisional application No. 60/010,310, Jan. 22, 1996.

[51] Int. Cl.[7] ..... E05F 15/00

[52] U.S. Cl. ..... 49/280; 49/362

[58] Field of Search ..... 49/360, 362, 280, 49/116, 118, 449

[56] References Cited

U.S. PATENT DOCUMENTS

| | | | |
|---|---|---|---|
| 1,139,905 | 5/1915 | Pitts | 49/362 X |
| 4,091,570 | 5/1978 | Favrel | 49/362 X |
| 4,198,786 | 4/1980 | Monot | 49/362 |
| 4,901,474 | 2/1990 | Bayard et al. | 49/280 X |
| 5,341,598 | 8/1994 | Reddy | 49/362 |

*Primary Examiner*—Jerry Redman
*Attorney, Agent, or Firm*—James Ray & Associates

[57] ABSTRACT

A lock assembly, for a door panel of a transit vehicle, has its locking action directly driven by the door operator into which it is incorporated. The locking assembly holds the door panel in a closed position through direct contact with the door panel, providing improved reliability by bypassing intermediate components of the door operator.

7 Claims, 4 Drawing Sheets

POWER DOOR OPERATOR HAVING ROTARY DRIVE AND DRIVE OPERATED DIRECT PANEL LOCK

CROSS-REFERENCE TO RELATED APPLICATIONS

This Appln. claims the benefit of U.S. Provitional Appln No. 60/010,310, filed Jan. 22 1996, and is a continuation of application Ser. No. 08/744,342, filed Nov. 7, 1996, now abandoned pursuant to 37 C.F.R. §1.53(d).

SPECIFICATION

TO ALL WHOM IT MAY CONCERN:

BE IT KNOWN THAT I, Redreddy Sukumar Reddy, a citizen of India, residing at 3601 Foster Street, City of Evanston, County of Cook, State of Illinois 60203, have invented a certain new and useful power door operator for a mass transit vehicle. The door operator features a rotary drive mechanism and a drive-operated direct panel lock assembly of which the following is a specification.

CROSS REFERENCE TO RELATED APPLICATIONS

The lock assembly disclosed herein is an improvement upon the lock assembly for the door operator disclosed in U.S. Pat. No. 5,341,598, and has the same inventor and assignee. The specification and claims of U.S. Pat. No. 5,341,598 are hereby incorporated by reference herein.

FIELD OF TEE INVENTION

The invention relates generally to power door operators of the type used on mass transit vehicles, such as subway cars, and light rail vehicles. More specifically, the invention relates to a lock assembly, for a door panel of a transit vehicle, whose locking action is directly driven by the door operator into which it is incorporated.

BACKGROUND OF THE INVENTION

It is well known that a transit vehicle has one or more openings or doorways through which passengers can enter and exit the vehicle. For a vehicle with more than one doorway, the openings will be located in the same sidewall or opposite sidewalls of the vehicle. Depending on the particular type of door system being considered, one or two door operators may be installed over each doorway. FIG. 1, for example, shows one door operator, and the door panel to which it is attached, installed over the left side of the doorway. A second door operator, and the right door panel attached thereto, is likewise installed over the right side of the doorway.

There are various types of door operators in use in the transit industry. Such door operators typically include a motor, some type of drive member and various related components. As is well known in the art, the motor of the door operator can be commanded to rotate in the opening or closing direction. By commanding its motor to rotate in the closing direction, a door operator responds by moving its corresponding door panel to the close position over the doorway, as is shown in FIG. 1. Reference numeral 3 in FIG. 1 is used to denote the door panels in the closed position. The phantom or dotted lines of FIG. 1 illustrate the open position that each door panel assumes when its drive member is rotated fully by the motor in the opening direction. Reference numeral 5 in FIG. 1 is used to denote the door panels in the (phantom) open position.

Although the door operator disclosed in U.S. Pat. No. 5,341,598 operates satisfactorily and is in current use, increased emphasis on equipment reliability and reduction of passenger hazards has created a need for a means of directly holding the door panels in a closed position over the doorway. The invention disclosed herein meets that need by a lock assembly that directly locks the door panel, thereby bypassing intermediate portions of the door operator-door panel structure. The lock assembly disclosed herein further improves reliability in that the door panel is maintained in a closed position, although the primary lock structure has deteriorated or the main drive structure may have failed.

OBJECTIVES OF THE INVENTION

It is, therefore, an objective of the invention disclosed herein to provide a lock assembly for a door panel of the type used in passenger transit vehicles wherein the lock assembly has its locking action directly driven by the door operator with which it is used to hold the door panel closed.

It is a further objective of invention to provide a lock assembly for a door panel of a passenger transit vehicle wherein the lock assembly retains the door panel in a closed position with a minimum number of components between the door operator and the lock assembly.

It is an additional objective of the invention disclosed herein to provide a lock assembly for a door panel of a passenger transit vehicle wherein the specific member of the lock assembly, when actuated, is mechanically isolated from the door operator that is used to actuate it.

SUMMARY OF THE INVENTION

The lock assembly of the invention disclosed herein uses a precise relationship between the rotation of a helical door drive member and the position of a door panel. This relationship between the rotary drive member and the location of the door panel allows incorporation of an extremely simply, highly reliable and low cost method of directly locking a door panel in transit vehicles that feature power door systems.

As disclosed, the components of the lock assembly are actuated by the rotating helical drive member only when the door panel is advanced by the helical drive member to a position where door panel is closed. The linearly advancing components of the lock assembly actuate an auxiliary lock structure incorporating a toggle mechanism resulting in the door panel being switched from the unlocked to the locked position within a predetermined number of degrees of rotation by the helical drive member. The lock assembly includes a simple lock fork that operates a horizontal shaft journalled longitudinally and in parallel to the helical drive member. The horizontal shaft is affixed to the base plate of the vehicle. A simple lock pawl lever, connected to the other end of the shaft, is moved to a position behind the door panel or hanger structure to lock the door panel in its fully closed position. Protection of the door panel and lock assembly position ensures that the components of the lock assembly are positioned properly before power is applied to the vehicle drive system.

Detection of the lock pawl in the locked position can be used to provide signal indicating the closed and locked status of the door panel.

BRIEF DESCRIPTION OF THE DRAWINGS

Other objectives and advantages of the invention will become apparent upon reading the following detailed description and upon reference to the following drawings, in which.

While the invention is described in connection with a first embodiment (wherein the lock assembly retains the door panel in a closed position through interference with the door hanger) and an alternate embodiment (wherein the lock assembly retains the door panel in a closed position through contact with an edge of the panel directly), it will be understood that there is no intention to limit the invention to those embodiments. On the contrary, the invention is intended to cover all alternatives, modifications and equivalents as may be included within the spirit and scope of the appended claims.

DETAILED DESCRIPTION OF THE INVENTION

Figure 1:
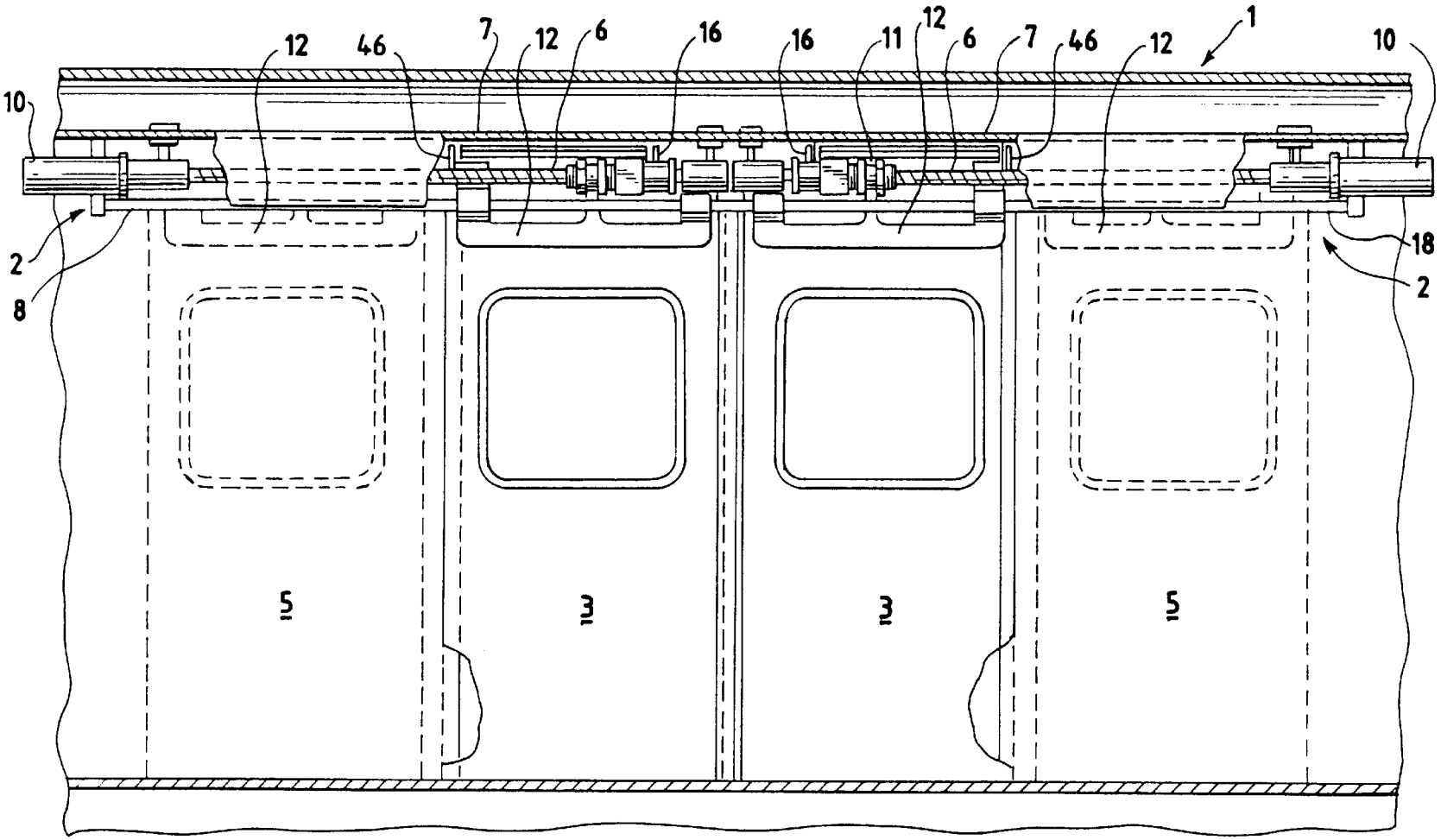
FIG. 1 is a plan view of a typical application of the door operator disclosed herein, when operating dual bi-parting doors on a transit vehicle, particularly showing the lock pawl of a novel lock assembly incorporated into the door operator.

Referring first to FIG. 1, the lock assembly 16 of the invention is a part of a door operator for a door panel of a typical transit vehicle. Designed to be controlled by a door controller unit (not described), the door operator is what physically opens and closes the door panel over a doorway of the transit vehicle. Mounted to the vehicle just above, and along the length of, the doorway is a base plate 7. It from this base plate 7 that the door operator is suspended by brackets over the doorway.

FIG. 1 actually shows two door operators, one installed over the left side of the doorway and the other over the right side of the doorway. These two door operators are essentially mirror-symmetrical mechanisms. For the sake of brevity, the door operator over the right side of the doorway, along with its associated lock assembly, is neither described nor illustrated in detail. Only the details of the door operator and associated lock assembly for the left side of the doorway are described in detail below. For this reason, FIGS. 2–8A illustrate only the door operator and associated lock assembly for the left side of the doorway.

Figure 2:
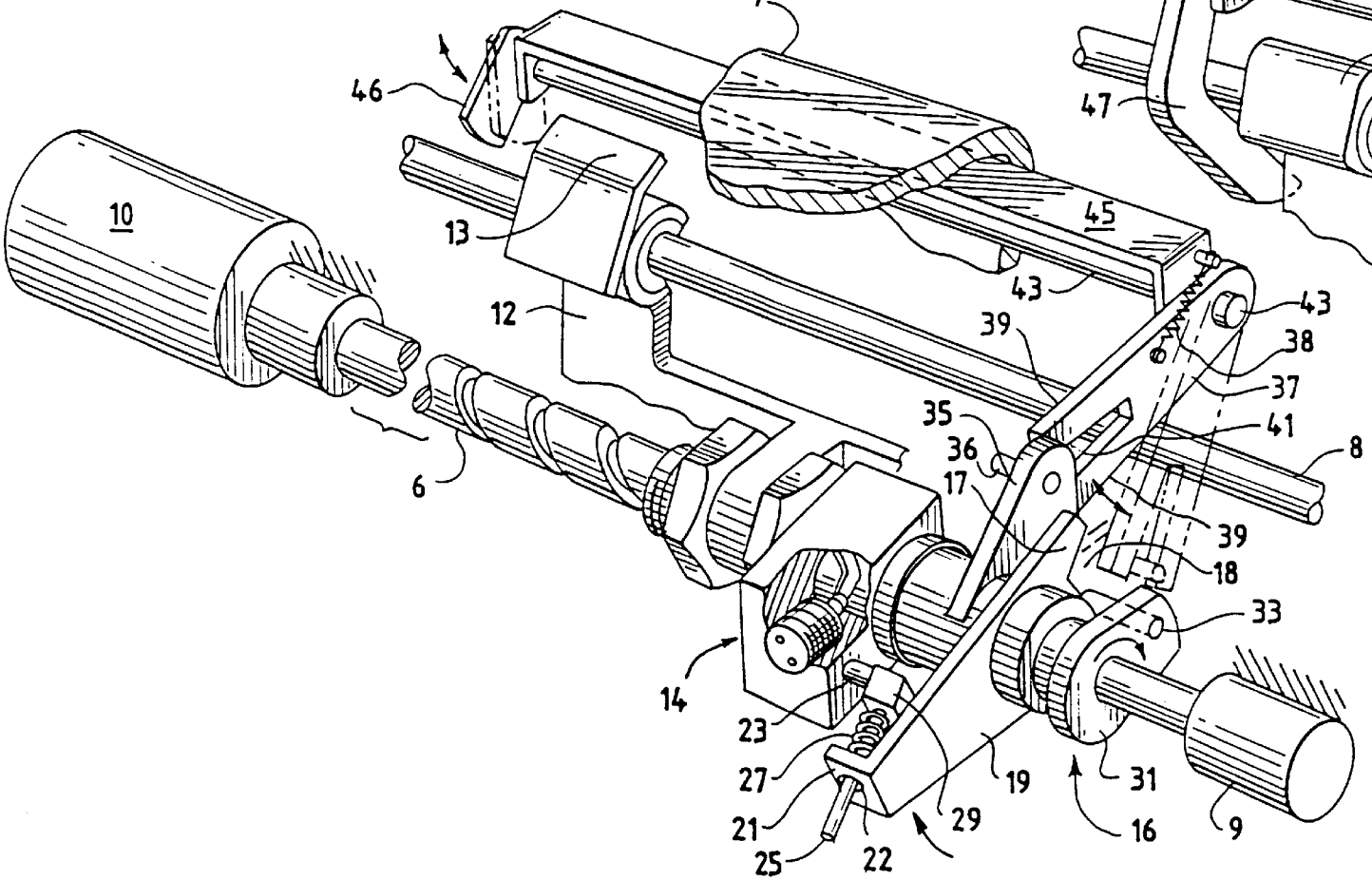
FIG. 2 is a partial perspective view of the door operator of the invention particularly showing the components of the lock assembly incorporated therein.
Figure 4:
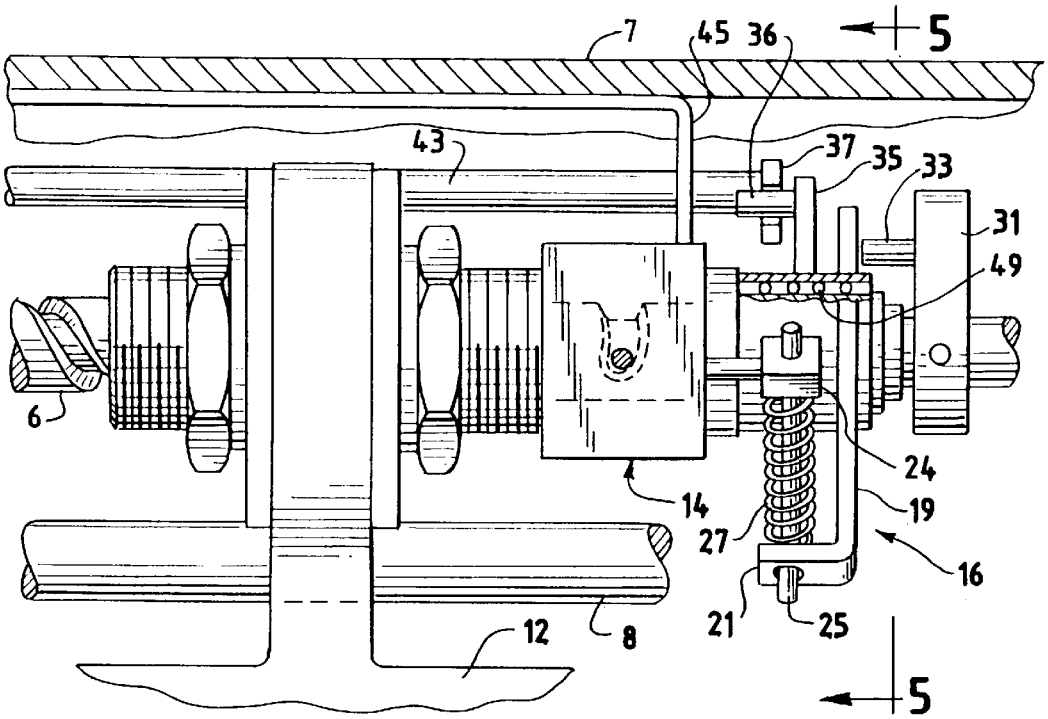
FIG. 4 is a partial side view of the lock assembly of the invention, particularly showing locations of the base plate, door hanger, helical drive member, and the components for the lock assembly of the invention, in position prior to actuation.

The door operator includes a helical drive member 6, a motor 10, and a drive nut assembly 14, as best shown in FIGS. 1, 2 and 4. Depending on which direction it is commanded to rotate by the door controller unit (not described), the motor 10 is what drives the helical drive member 6 to rotate in either the closing or opening direction. FIG. 2 shows that the drive member 6 is helically threaded along its most of its length. The drive nut assembly 14 has a nut whose threads are designed to match the helical threads of drive member 6. Drive nut assembly 14 thus rides along the length of helical drive member 6 when the motor 10 is rotated. The direction that drive nut assembly 14 travels along helical drive member 6 is, of course, determined by the direction in which motor 10 is rotated.

Also suspended from the base plate 7 by means of brackets is a door hanger rod 8, as is shown in FIGS. 1–4. As illustrated in FIG. 1, the left door panel 3 has its top edge attached to the lower, horizontally disposed portion of a door hanger 12. As best shown in FIG. 2, this door hanger 12 also interconnects door hanger rod 8 and drive nut assembly 14. Specifically, the upper portion of door hanger 12 has a hanger ring at each end and a looped flange in the middle. The looped flange is coupled within the drive nut assembly 14 around drive member 6, as best shown in FIG. 2. FIG. 1 best illustrates the two hanger rings at the opposite ends of door hanger 12, with each hanger ring collared around door hanger rod 8. By these hanger rings, door hanger rod 8 bears the weight not only of door hanger 12 but also of left door panel 3 to which door hanger 12 is attached. The drive nut assembly 14, and the left. door panel 3 to which it is coupled by the looped flange of door hanger 12, rides along the threads of drive member 6 in whichever direction drive member 6 is rotated. Carried by door hanger 12, the left door panel 3 will slide accordingly over the doorway between the open and closed positions. The door hanger 12 may carry bearings internal to each hanger ring to facilitate the sliding of the door panel 3 along the door hanger rod 8.

The right door panel 3 in FIG. 1 cooperates similarly with the door operator over the right side of the doorway. The two door panels 3 are thus part of a bi-parting, sliding door system typically used on mass transit vehicles.

Referring now to FIG. 2, the lock assembly 16 of the invention is incorporated at least partly within the door operator. The lock assembly 16 includes toggle lever 19, actuator cam 31, actuator arm 35, and lock shaft 43 and related. componentry. The toggle lever 19 is attached to a separately journalled portion about helical drive member 6, adjacent to drive nut assembly 14 as illustrated in FIG. 2.

The toggle lever 19 itself features a lock fork 17 at one end and an inwardly extending arm 21 at its other end.

Defined within the extending arm 21 is an aperture 22. Between the lines of lock fork 17 is gap 18.

Also attached to the separately journalled portion about helical drive member 6, actuator arm 35 is located inwardly of, and adjacent to, toggle lever 19. Actuator arm 35 is thus rotatably related to toggle lever 19 and capable of predetermined motion relative to helical drive member 6. Actuator arm 35 carries on its outer end a pin 36 that extends inwardly towards drive nut assembly 14. Near the rightmost end of helical drive member 6, actuator cam 31 is affixed to drive member 6. Actuator cam 31 carries on its outer end a pin 33 that extends inwardly in the direction of toggle lever 19.

Also attached to the separately journalled portion about helical drive member 6 via swivel rod 23 is a spring retention block 24. Spring retention block 24 has a spring retaining shaft 25 extending therefrom. The opposite end of retaining shaft 25 is retained in the aperture 22 defined within the extending arm 21 of toggle lever arm 19. A compression spring 27 surrounds retaining shaft 25 and is contained between one side of spring retention block 24 and the extending arm 21 of toggle lever 19.

Lock shaft 43 is rotatably mounted within a lock shaft support 45, as best shown in FIG. 2. The shaft support 45 is mounted to the base plate 7 of the vehicle. The lock shaft 43 has a lock fork 37 attached at its right end and a lock pawl 46 fixed to its left end. The lock fork 37 is journalled on lock shaft 43 for limited rotation in a plane perpendicular to helical drive member 6. Between the lines 39 of lock fork 37 is gap 41.

Figure 3:
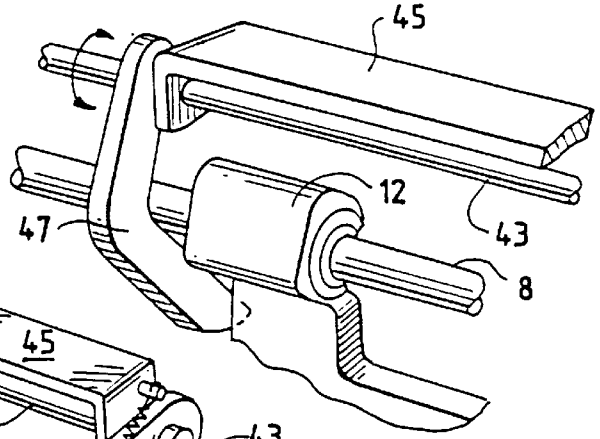
FIG. 3 is a further partial view of an alternate embodiment of the invention where the lock assembly of the invention incorporates an extended lock member which extends past the door hanger structure and prevents movement of the door panel from a closed position through direct contact with the door panel.
Figure 5:
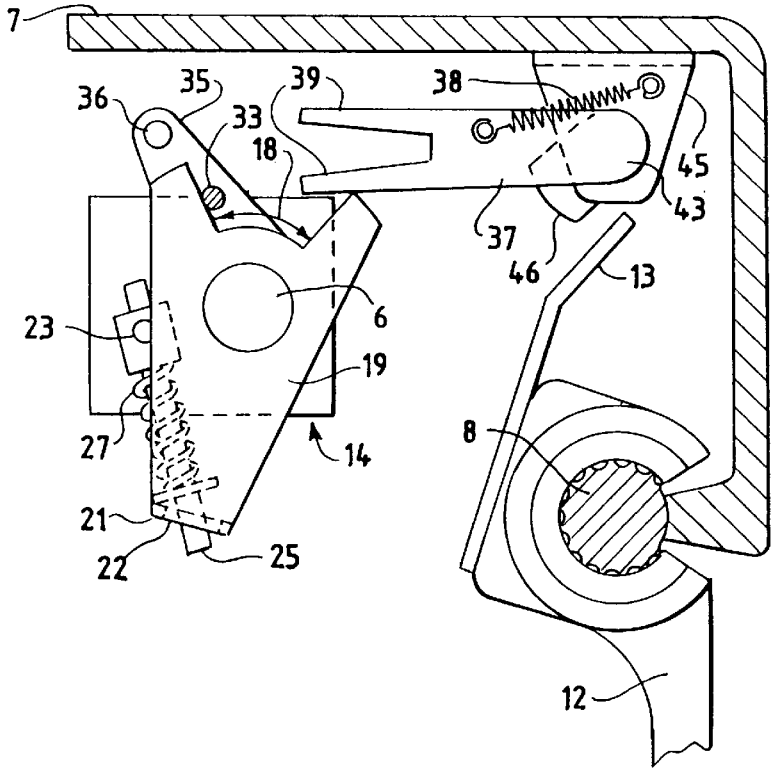
FIG. 5 is a section through FIG. 4 along the lines 5—5 of FIG. 4, particularly showing the components of the lock assembly in normal or unlocked position prior to entering the locking sequence.
Figure 5A:
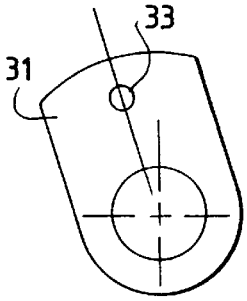
FIG. 5A is a partial view of the actuator cam and actuating pin corresponding to the position of same in FIG. 5.
Figure 6:
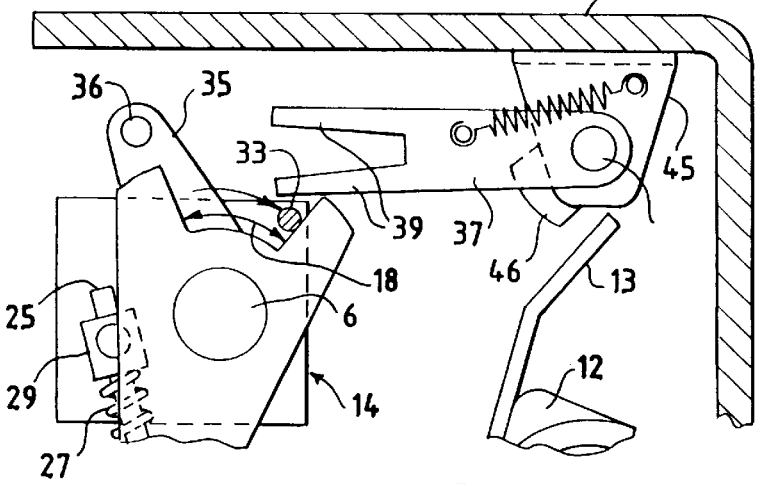
FIG. 6 is an additional section along the lines 5—5 of FIG. 4, however, showing the components of the lock assembly and base plate in an initial lock actuation position wherein the actuator cam with pin has rotated 60° from an unlocked position, with the pin of the actuator arm located in the gap of the toggle lever.
Figure 6A:
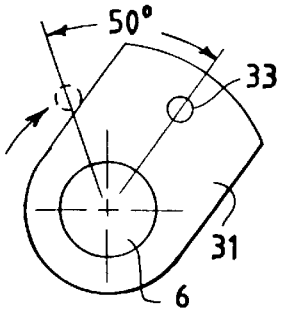
FIG. 6A is a partial view of the actuator cam and pin corresponding to the position of same in FIG. 6.

Lock pawl 46 can take the form of a short lever, as shown in FIG. 2, or a longer lever such as the one denoted 47 in FIG. 3. A bias spring 38 is used to bias lock fork 37, and thus lock pawl 46 via lock shaft 43, into the unlock position, as shown in FIGS. 5 and 6. As explained in detail in the following paragraphs, the lock pawl 46 is the specific member of lock assembly 16 that, when rotated and held in place behind the extension 13 of door hanger 12, physically locks the door panel 3 in the closed position.

Regarding the operation of lock assembly 16, the door panel moves from the open to closed position whenever the motor 10 of the door operator is commanded to rotate in the closing direction. Specifically, motor 10 drives helical drive member 6 in the closing direction thereby advancing drive nut assembly 14 from left to right, as best shown in FIG. 2.

The lock assembly will not begin its locking action. until the door operator has moved the door panel 3 to the closed position, as shown in FIG. 1. Specifically, the drive nut assembly 14, and the separately journalled portion on which actuator arm 35 and toggle lever 19 are carried, advances along helical drive member 6 and approaches pin 33 extending from actuator cam 31. At this point, no lock action has occurred. Referring now to FIG. 2, the helical drive member 6 has rotated far enough to advance drive nut assembly 14 and toggle lever 19 therewith leftward such that pin 33 on actuator cam 31 has entered the gap 18 between the lines of toggle lever 19. Specifically, as shown in FIG. 5, pin 33 of actuator cam 31 occupies a position in the extreme left hand side of gap 18 in lock fork 17.

Figure 7:
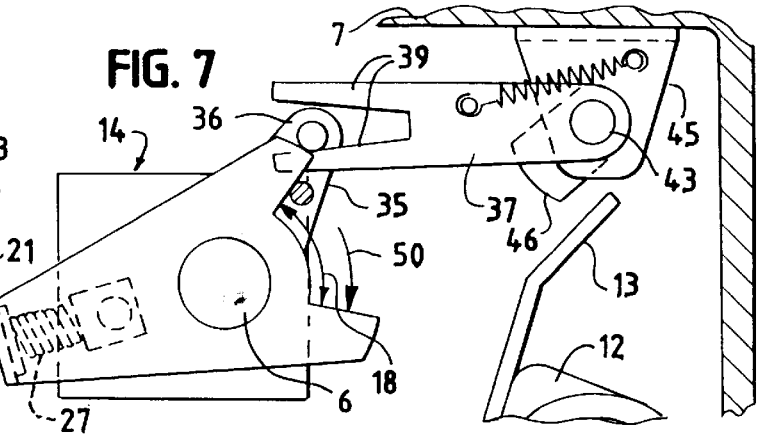
FIG. 7 is a further section along the lines of 5—5, particularly showing the components of the lock assembly in their respective partially actuated positions, with the toggle spring compressed, and the actuator cam and pin rotated by approximately 110°.
Figure 7A:
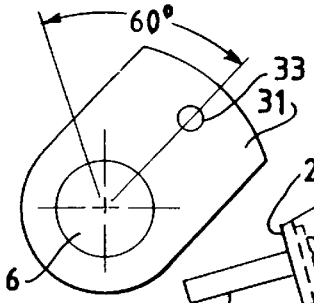
FIG. 7A is a partial view of the actuator cam and. pin corresponding to the position of same in FIG. 7.

Referring now to FIGS. 5 and 6, pin 33 of actuator cam 31 is captured in the gap 18 of lock fork 17. Consequently, as motor 10 continues to rotate helical drive member 6 in the closing direction, pin 33 causes toggle lever 19 via lock fork 17 to rotate clockwise, as shown in FIG. 6. This causes toggle lever 19 to rotate to a position in which spring 27 is; partially compressed. As motor 10 continues to rotate helical. drive member 6, actuator arm 35 rotates its pin 36 into the gap 41 between the lines 39 of lock fork 37, as is illustrated in FIG. 7. From the position at which actuator cam 31 is shown in FIGS. 1, the actuator cam has been rotated approximately 60°, as indicated by FIGS. 7 and 7A. It is at this point that toggle lever 19 has been rotated so as to completely compress spring 27 between the spring retention block 24 and extending arm 21.

Figure 8:
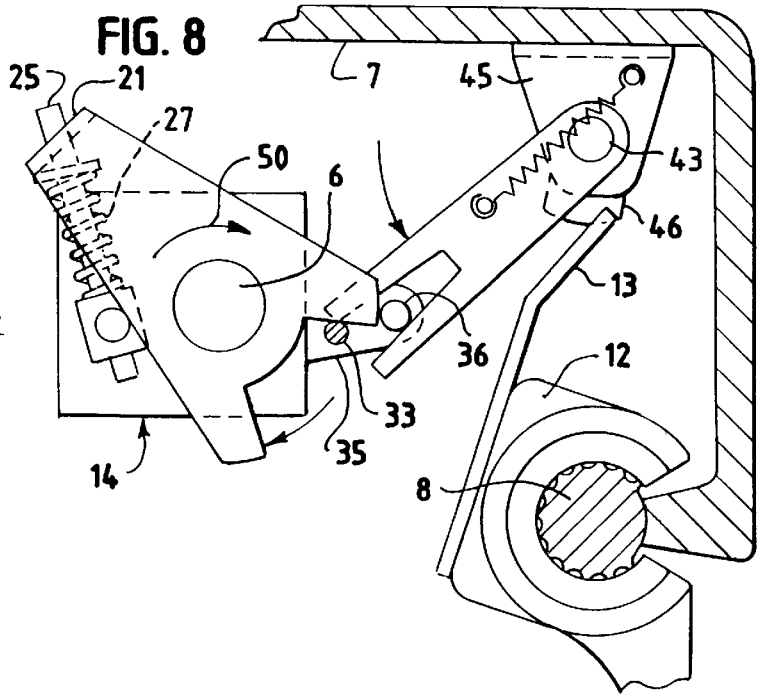
FIG. 8 is a further section along line 5—5 of FIG. 4, particularly showing the components of the lock assembly intheir respectivefully actuated positions wherein the actuator cam with pin has rotated 120° from an initial position shown in FIG. 5A, and the toggle lever and lock fork are in lock position.
Figure 8A:
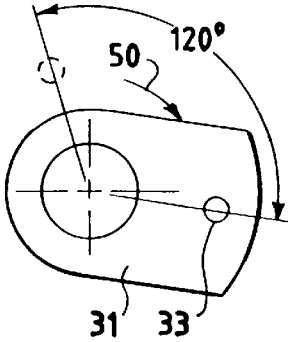
FIG. 8A is a partial view of the actuator cam and pin corresponding to the position of same in FIG. 8.

As motor 10 continues to rotate helical drive member 6 in the closing direction, actuator cam 31 by its pin 33 further rotates toggle lever 19, eventually to the position at which actuator cam 31 is 120° from the position it occupied in FIG. 5. At the point at which actuator cam 31 reaches the 120° position, spring 27 actuates toggle lever 19. By actuating, spring 27 quickly decompresses and thereby causes toggle lever 19, and actuator arm 35 therewith on the separately journalled portion, to quickly rotate further clockwise, as shown in FIG. 8. By this rotation, actuator arm 35 via its pin 36 causes lock fork 37 on lock shaft 43 to rotate counterclockwise to the lock position, as shown in FIG. 8. In this regard, reference can also be had to FIG. 2. Rotating helical drive member 6 120° from the unlocked position eventually causes pin 36 of actuator cam 35 to rotate lock fork 37 from its initial horizontal position shown in FIG. 2 to its lock position shown in dotted lines. Being fixed on the opposite end of lock shaft 43, lock pawl 46 rotates in place behind the extension 13 of door hanger 12 thereby physically locking the door panel 3 in the closed position.

For the lock assembly 16 of the invention, the lock sequence is initiated only when the door panel 3 is moved, along with door hanger 12 and drive nut assembly 14, to the closed position. Once toggle lever 19 has been actuated by spring 27 in the aforementioned manner, lock pawl 46 and extension 13 prevent the door panel 3 from being inadvertently reopened.

Referring again to the toggling of toggle lever 19, when motor 10 has rotated helical drive member 6 to the point at which actuator cam 31 reaches the 120° position, spring 27 actuates toggle lever 19. As pin 33 moves through 120°, it carries toggle lever 19 via lock fork 17 into its toggled position, wherein spring 27 is now re-extended. The toggle lever 19, actuator cam 31 and actuator arm 35 are all retained in this toggle position by the residual force exerted by the now re-extended spring 27. This residual force is thus also transmitted to lock fork 37 by pin 36 of actuator arm 35. This residual force provides several advantages in that lock fork 37, lock shaft 43, and lock pawl 46 are positively retained in the lock position. Also, the residual force on pin 33 of actuator cam 31 resists any tendency for helical drive member 6 to be driven by any external forces that otherwise could drive the door panel 3 toward the unlock position.

An alternate embodiment of the invention disclosed herein is particularly shown in FIG. 3. This embodiment of the invention is for use in situations where the door hanger 12 may not be positioned properly. Therefore, moving an alternative form of lock pawl, such as the extended lock member denoted by reference numeral 47 in FIG. 3, directly into the path of the trailing edge of door panel 3, after it has reached the closed position, is contemplated by the invention as disclosed.

Those skilled in the power door equipment arts will readily see that the availability of lock shaft 43 actuated by the door operator, and indeed, toggled into a relatively independent position, as described above, presents many additional configurations for locking door panels in order to provide positive panel locking in the event of failure of any portion of the door drive system.

Therefore, I claim:

1. In combination:

a rotary helical drive and an actuator horizontally disposed over an opening in a side wall of a passenger vehicle, said actuator including a drive nut on said helical drive, said drive nut attached to a door panel for reciprocating said door panel over and away from said opening in said side wall, thereby opening and closing said opening in said side wall, and a lock actuated by said helical drive for retaining said door panel in a closed and locked position over said opening in said side wall, said lock comprising:

means rotating said helical drive;

a lock cam attached to and rotating with one end of said helical drive;

a lock actuating pin on said lock cam, said lock actuating pin extending inwardly therefrom and along said helical drive;

first toggle means on said drive nut, said first toggle means advancing toward said lock actuating pin on rotation of said helical drive, said rotation moving said door panel from open to closed positions over said opening in said side wall; and second toggle means on a baseplate, said second toggle means actuated by said first toggle means and including a panel lock member, said panel lock member coacting with said door panel for retaining said door panel in said closed position when said second toggle means is actuated;

wherein rotation of said actuator advances said drive nut to said door closed position, and said lock actuating pin actuates said first toggle means, actuating said second toggle means whereby said panel lock member maintains said door panel in said closed position.

2. In combination:

a lock for a door operator having a rotary helical drive member and a cooperating nut running on said helical drive member for linear movement therealong on rotation of said helical drive member, said cooperating nut moving a door panel to closed and open positions over an opening in a side wall of a vehicle, comprising:

an operator baseplate for mounting said door operator on said side wall of said vehicle;

helical drive member on said baseplate;

a nut running on said helical drive member;

a door panel hanger attached to said cooperating nut;

means rotating said helical drive member;

lock means on an end of said helical drive member, said lock means extending perpendicularly therefrom; and toggle means intermediate said cooperating nut and said baseplate, said toggle means actuated by said lock means as said cooperating nut travels to said door closed position, said toggle means coacting with said door panel hanger to maintain said door panel in said door closed position;

wherein rotation of said helical drive member moves said cooperating nut and said door panel to said closed position, actuating said toggle means and said lock means thereby locking said door panel.

3. A door panel lock for a power door operator that uses a rotatable helical drive member in moving a door panel of a transit vehicle between open and closed positions, said power door operator being mounted to a baseplate attached to said transit vehicle, said door panel lock comprising:

a door drive nut assembly driven by and movable along said helical drive member for moving said door panel between said open and said closed positions;

lock means affixed to said helical drive member approximate one end thereof, said lock means having a first pin extending inwardly towards said door drive nut assembly;

door hanger means, connected to said door drive nut assembly, attaching said door panel and said door drive nut assembly;

first toggle means, disposed on said door drive nut assembly, for actuation by said lock means via said first pin thereof when said helical drive member has rotated beyond a point at which is needed to move said door drive nut assembly and said door panel therewith to said closed position; and second toggle means, linked to said baseplate, for actuation by said first toggle means upon actuation of said first toggle means with said lock means;

such that rotating said helical drive member beyond said point at which said door panel is in said closed position causes said lock means to fully engage said first toggle means and said first toggle means to fully engage said second toggle means thereby locking said door panel in said closed position.

4. The door panel lock of claim 3 wherein:

said door hanger means includes (i) a door hanger rod mounted to said transit vehicle and (ii) a door hanger member, attached to said door panel, slidable along with said door panel on said door hanger rod; and said second toggle means includes (i) a rotatable lock shaft journaled to said baseplate, (ii) a lock fork, attached at one end of said lock shaft, engageable by said first toggle means and (iii) a lock pawl attached at an opposite end of said lock shaft; such that upon engagement by said first toggle means, said lock fork causes said lock shaft and said lock pawl therewith to rotate into a lock position wherein said door hanger member and said door panel therewith are retained in said closed position.

5. The door panel lock of claim 4 wherein said lock means includes an actuator cam affixed to said one end of said helical drive member for rotation therewith, with said first pin extending inwardly of said actuator cam.

6. The door panel lock of claim 5 wherein said first toggle means comprises:

an actuator arm, disposed on said helical drive member inward of said actuator cam, said actuator arm having an inwardly extending toggle pin by which said actuator arm engages said lock fork of said second toggle means; and a first forked member, disposed on said helical drive member between said actuator cam and said actuator arm, for capturing and being rotated by said first pin of said actuator cam when said door drive nut assembly and said door panel therewith are driven beyond said closed position by said helical drive member.

7. The door panel lock of claim 6 wherein said first toggle means further includes a retention mechanism, said retention mechanism comprising:

a retention block;

a retaining shaft having one end fixed to said retention block and an opposite end reciprocally disposed within an aperture defined in an extending arm of said first forked member;

a spring, concentric to said retaining shaft, compressible by said extending arm against said retention block upon rotation of said first forked member; and a swivel rod connecting said retention block to said door drive nut assembly about which said retention block and said retention shaft therewith can pivot upon rotation of said first forked member in a plane perpendicular to an axis of said helical drive member;

such that as said helical drive member rotates beyond said closed position, said first pin of said actuator cam soon engages said first forked member and said retaining shaft therewith to rotate thus causing said spring to further compress and said toggle pin of said actuating arm to advance into engagement with said lock fork until a point at which said lock shaft and said lock pawl therewith are rotated to said lock position causing said spring to re-extend and thereby retain said retaining shaft and said first forked member therewith in a toggled position wherein said door hanger member and said door panel therewith are locked in said closed position.

* * * * *